US005160554A

United States Patent [19]

Bania et al.

[11] Patent Number: 5,160,554

[45] Date of Patent: Nov. 3, 1992

[54] ALPHA-BETA TITANIUM-BASE ALLOY AND FASTENER MADE THEREFROM

[75] Inventors: Paul J. Bania, Boulder City; Roy E. Adams, Henderson, both of Nev.; James Stokes, Ridgecrest, Calif.

[73] Assignee: Titanium Metals Corporation, Denver, Colo.

[21] Appl. No.: 750,420

[22] Filed: Aug. 27, 1991

[51] Int. Cl.[5] ..... C22C 14/00

[52] U.S. Cl. ..... 148/407; 148/670; 420/417; 420/418; 420/420

[58] Field of Search ..... 148/11.5 F, 407; 420/417, 418, 420

[56] References Cited

U.S. PATENT DOCUMENTS

| | | | |
|---|---|---|---|
| 4,600,449 | 7/1986 | White et al. | 148/407 |
| 4,799,975 | 1/1989 | Ouchi et al. | 148/11.5 F |
| 4,878,966 | 11/1989 | Alheritiere et al. | 148/11.5 F |
| 4,889,170 | 12/1989 | Mae et al. | 148/407 |

OTHER PUBLICATIONS

Chait et al. in Titanium Science & Technology (eds. Jaffee et al.) vol. 2, Plenum, N.Y. 1973, p. 1377.

*Primary Examiner*—Upendra Roy

*Attorney, Agent, or Firm*—Finnegan, Henderson, Farabow, Garrett & Dunner

[57] ABSTRACT

An alpha-beta titanium-base alloy, and fastener made therefrom. The alloy has a combination of an ultimate tensile strength of at least 220 ksi with a minimum elongation of 7% in the solution-treated and aged condition. The alloy has a total beta stabilizer content of 15 to 20%, a total alpha stabilizer content of 1.5 to 3.5% and balance titanium. The alloy may have an aluminum equivalence of at least 3.0%, preferably 4.0%. The alloy may have an aluminum content of at least 1.5%. The beta stabilizer element may be at least one vanadium, molybdenum or iron and the alpha stabilizer element may be one or more of aluminum, oxygen, carbon and nitrogen.

7 Claims, 3 Drawing Sheets

ALPHA-BETA TITANIUM-BASE ALLOY AND FASTENER MADE THEREFROM

BACKGROUND OF THE INVENTION

1. Field of the Invention

The invention relates to an alpha-beta titanium-base alloy, and fastener made therefrom. The alloy is characterized by an improved combination of strength and ductility.

2. Description of the Prior Art

The most widely used titanium-base alloy is the alpha-beta alloy Ti-6Al-4V, which is used for a wide range of applications, including sheet metal components, plate products, forgings and rod and bar products. With respect to rod and bar products, this alloy has obtained wide usage in the aerospace industry for the manufacture of fasteners. For fastener applications, the mechanical property of the alloy of most concern is the shear strength. This alloy at its highest usable heat-treated strength level has a minimum of 95 ksi shear strength with the typical shear strength range being 95 to 105 ksi. This corresponds to a typical uniaxial ultimate tensile strength (UTS) of approximately 165 to 180 ksi. Because of hardenability limitations at these strength levels, the alloy is limited to use in the production of fasteners having diameters of approximately less than 0.625 inch. At greater diameters, it is difficult to heat treat the material to adequate hardenability levels for most fastener applications.

Consequently, for fastener applications wherein larger section sizes, or higher strength levels, are required, it is conventional practice to use iron- or nickel-base alloys which are known to exhibit minimum shear strength values of 125 ksi, which correspond to 220 ksi UTS. When these alloys are used instead of titanium-base alloys, however, there results a substantial weight penalty of approximately 40%. This results from the fact that iron- and nickel-base alloys are generally 0.29 to 0.31 lb/cu.; whereas, titanium-base alloys are generally 0.165 to 0.180 lb/cu.

Weight is typically an important design consideration in most aerospace applications, and therefore it is desirable to use a titanium alloy wherein heavier section sizes and/or higher strength levels may be obtained at relatively lower weight than obtained with iron- or nickel-base alloys.

It is recognized, however, that for any alloy to be used for fastener applications a minimum level of ductility is required. Specifically, for fastener applications, this is approximately 7% elongation. Consequently, a titanium-base alloy for fastener applications desirably has 220 ksi UTS, 125 ksi shear strength and 7% elongation. It is difficult to obtain accurate and reproducible values for shear strength. Consequently, it has been determined that the shear strength minimum levels required for most fastener applications are achieved with an alloy having the capability of obtaining at least 220 ksi UTS at a minimum ductility of 7% elongation.

SUMMARY OF THE INVENTION

It is accordingly an object of the present invention to provide an alpha-beta titanium-base alloy having a combination of ultimate tensile strength and minimum elongation suitable for use in the manufacture of fasteners over the entire range of typical fastener diameters.

A more specific object of the invention is to provide an alpha-beta titanium-base alloy for fastener applications where the strength level is sufficient to permit hardenability to desired levels, while maintaining the required minimum ductility.

Another object in the invention is to provide an alpha-beta titanium-base alloy fastener having the minimum required strength and elongation.

In accordance with the invention an alpha-beta titanium-base alloy is provided, which alloy may be in the form of a fastener. The alloy exhibits in combination ultimate tensile strength of at least 220 ksi, with a minimum elongation of 7% in the solution-treated and aged condition. The alloy in the broadest aspects of the invention has a total beta stabilizer element content of 15 to 20, a total alpha stabilizer content of 1.5 to 3.5% and balance titanium.

The alloy, or fastener made therefrom, may have an Al equiv of at least 3.0%, preferably 4.0%, with at least 1.5% aluminum.

The beta stabilizer content may comprise vanadium, molybdenum or iron.

The alpha stabilizer content may comprise aluminum, oxygen, carbon and nitrogen, with aluminum and oxygen being preferred.

A preferred range for the alloy in accordance with the invention is 5–7% vanadium, 5–7% molybdenum, 5–7% iron, 1.5–3.5% aluminum, up to 0.35% oxygen and balance titanium.

The fastener made of an alloy composition in accordance with the invention may have a diameter of at least 0.625 inch.

DESCRIPTION OF THE PREFERRED EMBODIMENT

Figure 1:
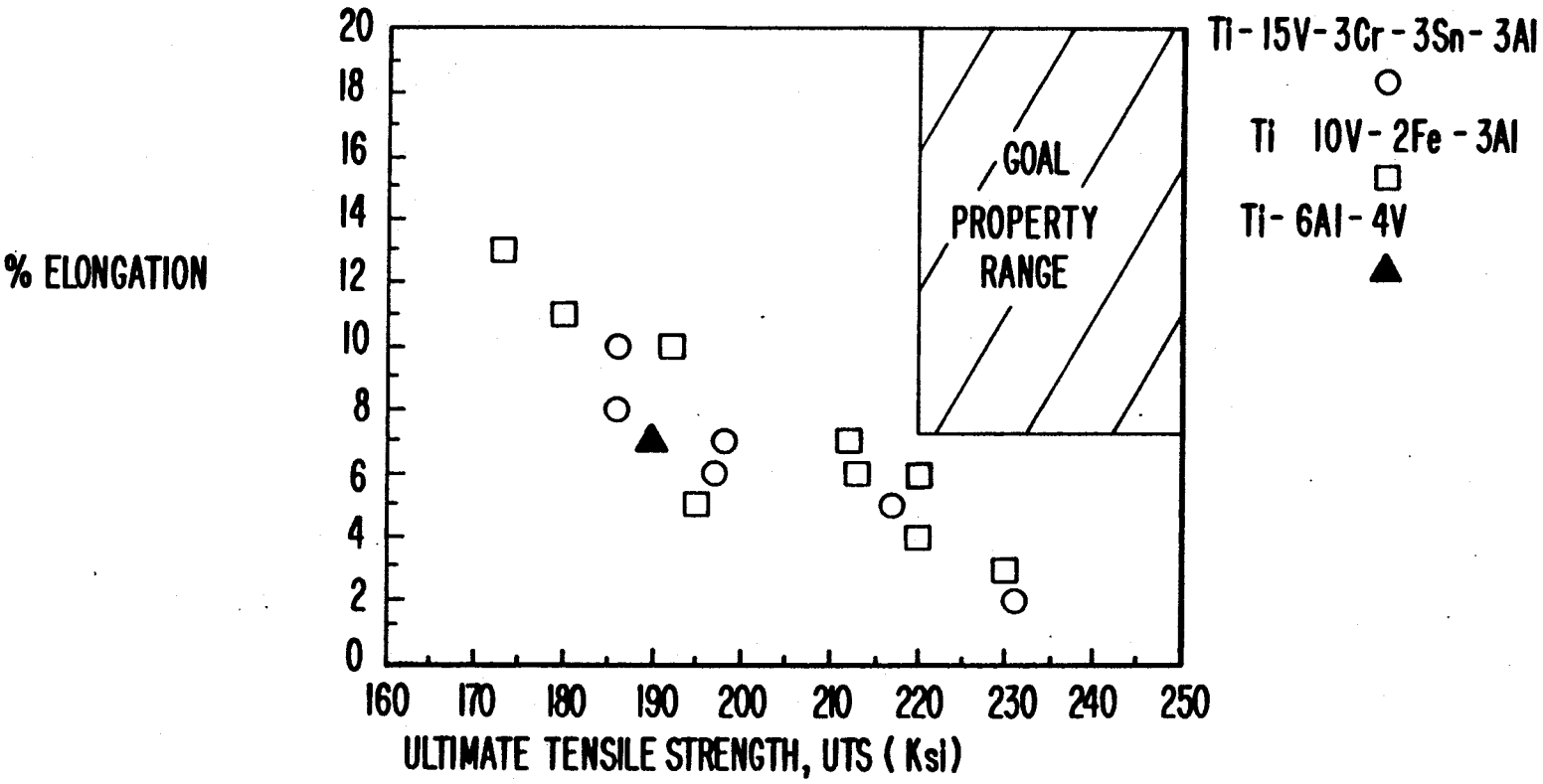
FIG. 1 is a graph showing the combination of percent elongation and ultimate tensile strength of conventional high-strength titanium alloys, including Ti-6Al-4V with respect to the goal property range for this combination of percent elongation and ultimate tensile strength for fastener applications in accordance with the invention.

By way of demonstration of the invention, and particularly to demonstrate the deficiencies of the properties of conventional titanium-base alloys for fastener applications, a series of 30-pound laboratory heats were melted and processed to 0.5 inch diameter round bars. The bars were heat treated to various strength levels and subjected to tensile testing. The alloy compositions melted and the tensile test results are set forth in Table I and the graph constituting FIG. 1. As may be clearly observed from the graph of FIG. 1, these conventional alloys do not meet the goal properties for fastener applications. Specifically in this regard, as shown in FIG. 1, the data point for Ti-6Al-4V, which represents the practical limit for this alloy as a 0.5 inch diameter bar solution treated and aged is clearly deficient with regard to the fastener goal property range constituting the combination of percent elongation and ultimate tensile strength.

TABLE I

Tensile Data From Lab Heats of Conventional High Strength Alloys

| Alloy | Tensile Data[1] UTS (ksi) | % El |
|---|---|---|
| Ti—15V—3Cr—3Sn—3Al—.14$O_2$ | 186 | 8 |
| | 186 | 10 |
| | 197 | 6 |
| | 198 | 7 |
| | 217 | 5 |
| | 231 | 2 |
| Ti—10V—2Fe—3Al—.10$O_2$ | 173 | 13 |
| | 180 | 11 |
| | 192 | 10 |
| | 195 | 5 |
| | 212 | 7 |
| | 213 | 6 |
| | 220 | 4 |
| | 220 | 6 |
| | 230 | 3 |

Note:
30-Lb Ingots: Forged from 6" dia. ingot to 3" dia. billet from above the beta transus temperature then alpha-beta rolled from 3" square to ½" round from 50° F. below the respective beta transus. All were then solution treated 25° F. to 75° F. below the beta transus then aged at various times/temperatures to produce a range of strengths.

A further series of experimental alloys were melted in laboratory size heats of 30 to 40 pounds, and processed to 0.5 inch diameter rods by processing similar to that used for the alloys of Table I. After hot rolling to finished size, specimen blanks were cut and heat treated (solution treated) at temperatures ranging from 25° F. to 75° F. below the beta transus temperature for each of the alloys. The specimens were then water quenched, and aged for various times (1 to 24 hours) at various temperatures (800° to 1100° F.) to produce a variety of strength/ductility combinations.

In order to facilitate comparing the different formulations, the tensile data (UTS vs. corresponding % elongation) was analyzed by regression analysis so that an equation of the form:

% El=A-b (UTS)

where % El=Elongation (in %) from a room temperature tensile test

UTS=Ultimate tensile strength (in ksi) corresponding to above % El

Figure 2:
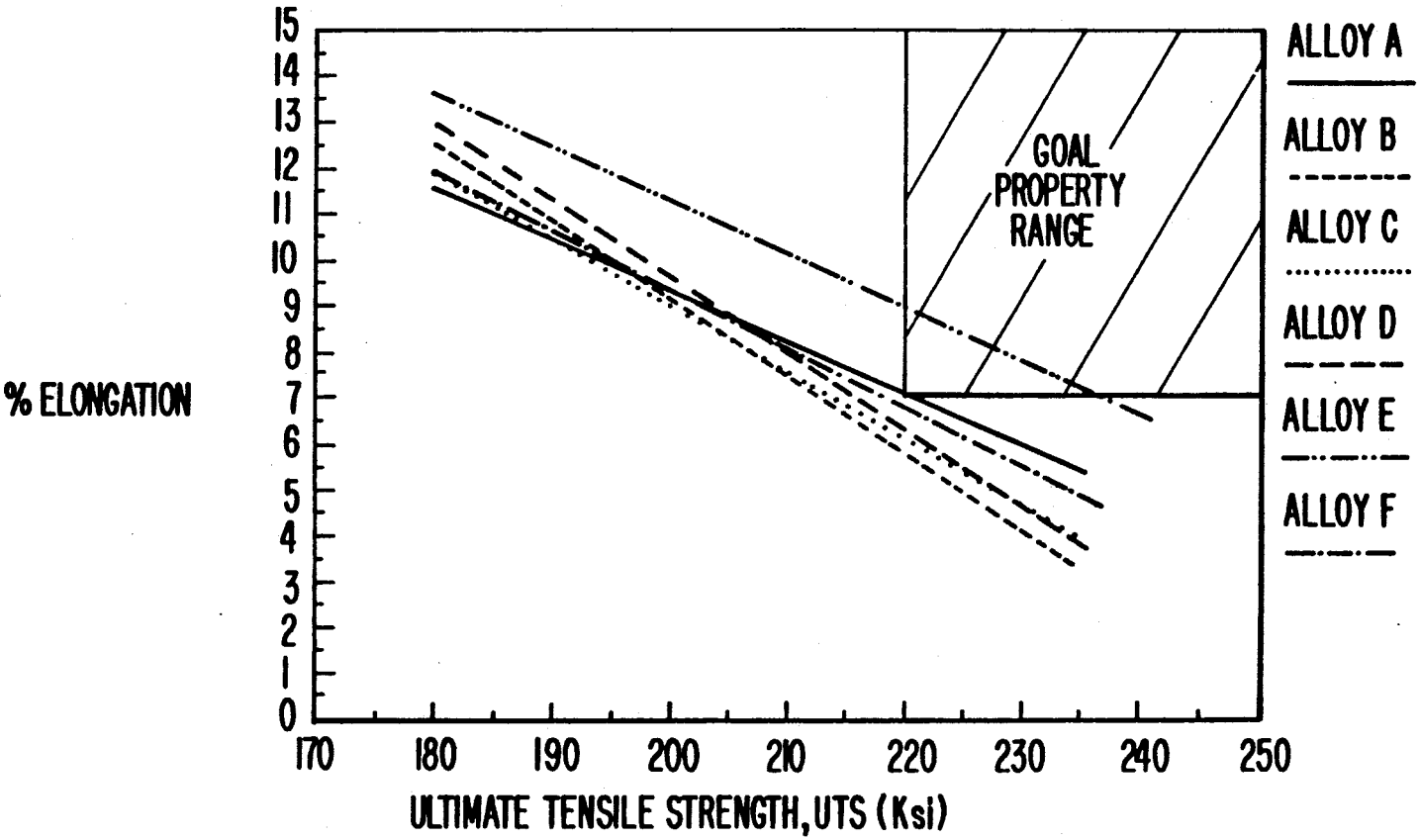
FIG. 2 is a graph similar to FIG. 1 plotting regression curves for various alloys with respect to percent elongation and ultimate tensile strength in combination compared to the goal property range for fastener applications.
Figure 3:
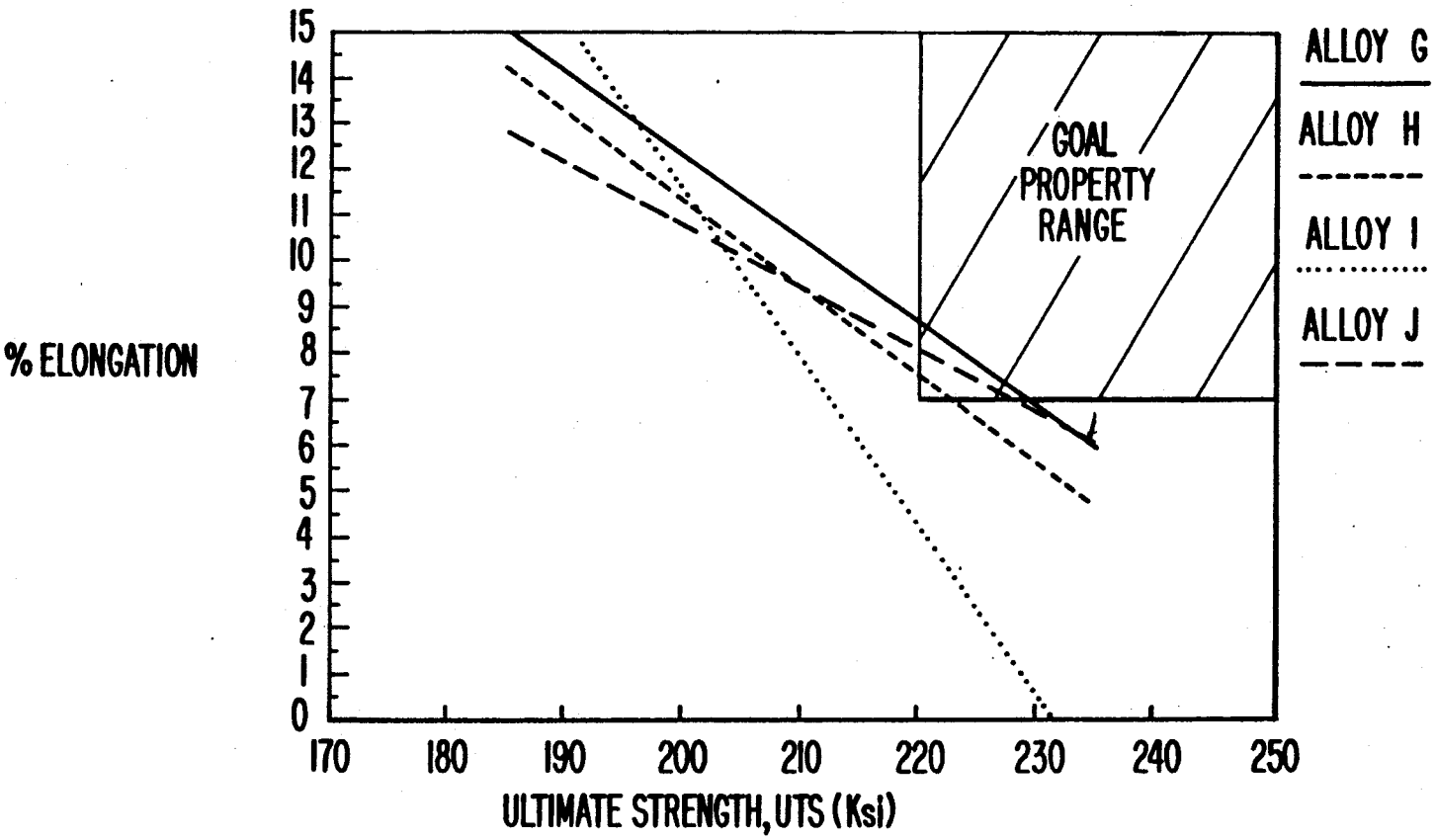
FIG. 3 is a similar graph plotting regression curves for additional alloys with respect to the combination of percent elongation and ultimate tensile strength compared to the goal property range.

A,b=Constants derived from regression analysis of data could be used to compare results. Once the A and b constants are computed from the data, they can be used to calculate the expected ductility (% El) at any desired strength level, or to plot a line representing the alloy on a plot such as shown in FIG. 2.

The alloy compositions evaluated are listed in Table II, along with their respective tensile data resulting from the solution treatments and aging cycles described above.

TABLE II

Tensile Results Of Beta Stabilizer Effects

| Alloy No. | Alloy Composition V | Mo | Fe | Al | $O_2$ | Ti | Tensile Properties UTS (ksi) | % El |
|---|---|---|---|---|---|---|---|---|
| A | 5.8 | 4.5 | 5.7 | 3 | .13 | Bal | 174 | 10.0 |
| | | | | | | | 187 | 11.2 |
| | | | | | | | 194 | 12.8 |
| | | | | | | | 210 | 9.0 |
| | | | | | | | 210 | 8.0 |
| | | | | | | | 213 | 8.0 |
| | | | | | | | 228 | 6.5 |
| | | | | | | | 228 | 5.2 |
| | | | | | | | 233 | 5.0 |

TABLE II-continued

Tensile Results Of Beta Stabilizer Effects

| Alloy No. | Alloy Composition V | Mo | Fe | Al | $O_2$ | Ti | Tensile Properties UTS (ksi) | % El |
|---|---|---|---|---|---|---|---|---|
| B | 5.8 | 4.5 | 4.5 | 3 | .13 | Bal | 197 | 9.1 |
| | | | | | | | 203 | 9.0 |
| | | | | | | | 205 | 8.2 |
| | | | | | | | 209 | 8.0 |
| | | | | | | | 210 | 7.9 |
| | | | | | | | 212 | 7.0 |
| | | | | | | | 218 | 5.9 |
| | | | | | | | 221 | 5.0 |
| | | | | | | | 223 | 5.6 |
| C | 4.8 | 4.3 | 5.7 | 2.7 | .13 | Bal | 191 | 8.0 |
| | | | | | | | 194 | 10.1 |
| | | | | | | | 195 | 11.3 |
| | | | | | | | 209 | 8.5 |
| | | | | | | | 213 | 8.1 |
| | | | | | | | 213 | 7.5 |
| | | | | | | | 221 | 6.5 |
| | | | | | | | 222 | 4.5 |
| | | | | | | | 222 | 5.1 |
| D, | 4.8 | 4.3 | 4.5 | 2.7 | .13 | Bal | 200 | 10.0 |
| | | | | | | | 207 | 9.0 |
| | | | | | | | 207 | 8.0 |
| | | | | | | | 214 | 7.5 |
| | | | | | | | 214 | 6.9 |
| | | | | | | | 218 | 6.2 |
| | | | | | | | 220 | 5.2 |
| | | | | | | | 223 | 7.0 |
| | | | | | | | 224 | 5.9 |
| E | 6 | 6.2 | 5.7 | 2.7 | .13 | Bal | 176 | 13.5 |
| | | | | | | | 177 | 13.9 |
| | | | | | | | 191 | 12.8 |
| | | | | | | | 201 | 11.1 |
| | | | | | | | 204 | 13.0 |
| | | | | | | | 206 | 10.6 |
| | | | | | | | 208 | 10.0 |
| | | | | | | | 214 | 7.1 |
| | | | | | | | 220 | 10.0 |
| F | 6 | 6.2 | 4.5 | 2.7 | .13 | Bal | 178 | 11.0 |
| | | | | | | | 185 | 12.0 |
| | | | | | | | 189 | 12.0 |
| | | | | | | | 207 | 9.0 |
| | | | | | | | 207 | 8.2 |
| | | | | | | | 207 | 7.3 |
| | | | | | | | 216 | 7.9 |
| | | | | | | | 216 | 6.9 |
| | | | | | | | 220 | 6.8 |

Note:
30-Lb Ingots: Forged from 6" dia. ingot to 3" dia. billet from above the beta transus temperature, then alpha-beta rolled from 3" square to ½" round from 50° F. below the beta transus temperature. All were then solution treated 25° F. to 75° F. below the beta transus then aged at various times/temperatures to produce a range of strengths.

These compositions were produced with varying levels of beta stabilizer content (V, Mo and Fe) and fixed levels of alpha stabilizer content (Al and $O_2$).

The data from Table II was analyzed by linear regression analysis and the resulting constants are given in Table III. Also given in Table III is the calculated value of ductility for each alloy at the goal UTS level of 220 ksi. Clearly, the E formulation alloy has the best ductility at 220 UTS. Notably, this alloy is high (i.e., >5%) in V, Mo, and Fe. The next best alloys are those with two out of three of these beta stabilizing elements being >5% (Alloys A and F). Finally, the poorest alloys had either two or three of these elements below the 5% level. These results suggest that for optimum strength-/ductility properties, it is critical that all three beta stabilizers be above the 5% level.

TABLE III

Regression Analysis of Table II Data

| Alloy[3] | V | Mo | Fe | Regression Constants[1] A | Regression Constants[1] b | Calculated % El @[2] 220 ksi UTS |
|---|---|---|---|---|---|---|
| A | 5.8 | 4.5 | 5.7 | 31.55 | −.11097 | 7.14 |
| B | 5.8 | 4.5 | 4.5 | 42.64 | −.16759 | 5.77 |
| C | 4.8 | 4.3 | 5.7 | 38.21 | −.14580 | 6.13 |
| D | 4.8 | 4.3 | 4.5 | 42.74 | −.16550 | 6.33 |
| E | 6.0 | 6.2 | 5.7 | 34.35 | −.11528 | 8.99 |
| F | 6.0 | 6.2 | 4.5 | 34.71 | −.12672 | 6.83 |

Note:
[1]Data from Table II analyzed by regression analysis for an equation of the form: % El = A + b (UTS).
[2]Calculated from (1).
[3]All alloys at 3Al—.13$O_2$.

A similar result is seen when the linear regression data from Table III is plotted as shown in FIG. 2. This plot demonstrates that the Alloy E formulation—the one high in V, Mo and Fe—is the only one capable of meeting the goal properties.

TABLE IV

Tensile Results Of Alpha Stabilizer Effects

| Alloy No. | Alloy Composition V | Mo | Fe | Al | $O_2$ | Ti | Tensile Properties UTS (ksi) | % El |
|---|---|---|---|---|---|---|---|---|
| G | 6.1 | 6.2 | 5.7 | 3.2 | .13 | Bal | 205 | 11.0 |
| | | | | | | | 207 | 11.0 |
| | | | | | | | 219 | 10.0 |
| | | | | | | | 220 | 8.8 |
| | | | | | | | 230 | 6.1 |
| | | | | | | | 230 | 7.1 |
| H | 5.2 | 5.5 | 5.2 | 2.7 | .13 | Bal | 207 | 10.2 |
| | | | | | | | 218 | 7.0 |
| | | | | | | | 219 | 7.9 |
| | | | | | | | 221 | 8.0 |
| | | | | | | | 230 | 6.0 |
| | | | | | | | 231 | 5.1 |
| I | 5.0 | 5.1 | 5.0 | 1.5 | .14 | Bal | 198 | 13.0 |
| | | | | | | | 199 | 11.1 |
| | | | | | | | 203 | 10.1 |
| | | | | | | | 208 | 10.0 |
| | | | | | | | 212 | 7.0 |
| | | | | | | | 220 | 4.0 |
| J | 5.2 | 5.2 | 5.1 | 1.6 | .31 | Bal | 213 | 10.0 |
| | | | | | | | 217 | 7.2 |
| | | | | | | | 220 | 7.9 |
| | | | | | | | 220 | 8.0 |
| | | | | | | | 231 | 5.0 |
| | | | | | | | 237 | 7.0 |

Note:
30-Lb Ingots: Forged from 6" dia. ingots to 3" dia. billets from above the beta transus temperature then alpha-beta rolled from 3" square to ½" round from 50° F. below beta transus temperature. All were then solution treated 25° F. to 75° F. below the beta transus then aged at various times/temperatures to produce a range of strengths.

TABLE V

Regression Analysis of Table IV Data

| Alloy | V | Mo | Fe | Al | $O_2$ | Regression Constants[1] A | Regression Constants[1] b | Calculated % El[2] @ 220 ksi UTS |
|---|---|---|---|---|---|---|---|---|
| G | 6.1 | 6.2 | 5.7 | 3.2 | .13 | 48.45 | −.18057 | 8.72 |
| H | 5.2 | 5.5 | 5.2 | 2.7 | .13 | 49.64 | −.19128 | 7.56 |
| I | 5.0 | 5.1 | 5.0 | 1.5 | .14 | 85.27 | −.36811 | 4.28 |
| J | 5.2 | 5.2 | 5.1 | 1.6 | .31 | 37.79 | −.13502 | 8.09 |

Note:
[1]Data from Table IV analyzed by regression analysis for an equation of the form: % El = A = b (UTS)
[2]Calculated from (1).

TABLE VI

Aluminum Equivalence Comparison Of Alpha Stabilizer Heats

| Alloy | Al[2] | O[2] | Al Equiv.[1] | % Elongation[2] @ 220 ksi UTS |
|---|---|---|---|---|
| G | 3.2 | .13 | 4.5 | 8.72 |
| H | 2.7 | .13 | 4.0 | 7.56 |
| I | 1.5 | .14 | 2.9 | 4.28 |
| J | 1.6 | .31 | 4.7 | 8.09 |

Note:
[1]Al Equiv. = % Al + (% $O_2$)* 10.
[2]Table V value for ductility.

Another series of 30-lb heats was evaluated in order to assess the effects of the principle alpha stabilizers used in the alloy—i.e., aluminum and oxygen. Table IV summarizes the chemistries and resultant properties from this group of heats, while Table V provides the regression analysis summary. Table VI shows the following:

a) The Alloy G chemistry, which is very similar to the Alloy E chemistry, again exhibited over 8.5% El at 220 ksi.
b) The Alloy H chemistry showed that over 7.5% elongation was achieved in an alloy with all beta stabilizers near 5% and Al as low as 2.7%. However, since 7% is the goal ductility, this suggests that lower aluminum could reduce ductility below 7%.
c) Alloy I confirms that low aluminum (1.5%) in an alloy similar to Alloy H reduced ductility to below acceptable levels.
d) Alloy J shows that when one alpha stabilizer (Al) is low, it can be compensated for by adding more of another alpha stabilizer, such as oxygen. This suggests a minimum combination of the two alpha stabilizers. It is recognized that other alpha stabilizers, particularly interstitial elements such as nitrogen and carbon, can also substitute for these alpha stabilizers. However, as Al and $O_2$ are the primary ones used in most commercial alloys, only these were evaluated in this alloy. Nonetheless, nitrogen and carbon could be substituted for oxygen in an equation of the following form:

$$\text{Al equiv} = \%\ Al + (\%\ O_2 + 0.67C + 2.0N) \times 10.$$

It is known that alpha stabilizers can be viewed in a combined manner as an "Aluminum Equivalence":

$$Al\ \text{Equivalence} = \%\ Al - (\%\ O_2) \times 10 + (\%\ Sn) \times .33 + (\%\ Zr) \times .67$$

Since Zr and Sn are not used in the alloys of interest, Al equivalence = % Al + (% $O_2$) × 10. Table VI compares the aluminum equivalence of the Tale IV alloys with their expected ductilities at 220 ksi UTS. Although an exact critical limit cannot be ascertained, it is clear that an equivalency of 4.0 is beneficial while a value below 3.0 is harmful.

As used herein, all percentages are in percent by weight unless otherwise indicated.

The term "fastener" in accordance with the invention may be defined as an article used to join sheet metal to other sheet metal or to underlying structure.

The term "beta stabilizer" as used herein refers to any element that lowers the allotropic transformation temperature of the high temperature body centered cubic (BCC) phase to the lower temperature hexagonal close packed (HCP) phase, including but not limited to the elements Mo, V, Fe, Mn, Ni, Cu, Cr, Ta, Nb, and H.

The term "alpha stabilizer" as used herein refers to any element that raises the allotropic transformation temperature of the high temperature body centered cubic (BCC) phase to the lower temperature hexagonal close packed (HCP) phase including but not limited to Al, $O_2$, N, and carbon.

What is claimed is:

1. An alpha-beta titanium-base alloy having in combination ultimate tensile strength of at least 220 ksi with a minimum elongation of 7% in the solution-treated and aged condition, said alloy consisting essentially of, in weight percent, a total alpha stabilizer content of 1.5 to 3.5, 5 to 7 vanadium, 5 to 7 molybdenum, 5 to 7 iron and balance titanium.

2. An alpha-beta titanium-base alloy having in combination ultimate tensile strength of at least 220 ksi with a minimum elongation of 7% in the solution-treated and aged condition, said alloy consisting essentially of, in weight percent, 5 to 7 vanadium, 5 to 7 molybdenum, 5 to 7 iron, 1.5 to 3.5 aluminum, up to 0.35 oxygen and balance titanium.

3. The alloy of claim 2 having an Al equiv of at least 3.0.

4. An alpha-beta titanium-base alloy fastener having in combination ultimate tensile strength of at least 220 ksi with a minimum elongation of 7%, said alloy consisting essentially of, in weight percent, a total alpha stabilizer content of 1.5 to 3.5, 5 to 7 vanadium, 5 to 7 molybdenum, 5 to 7 iron and balance titanium.

5. alpha-beta titanium-base alloy fastener having in combination ultimate tensile strength of at least 220 ksi with a minimum elongation of 7%, said alloy consisting essentially of, in weight percent, 5 to 7 vanadium, 5 to 7 molybdenum, 5 to 7 iron, 1.5 to 3.5 aluminum, up to 0.35 oxygen and balance titanium.

6. The alloy fastener of claim 5 having an Al equiv of at least 3.0.

7. The alloy fastener of claims 5 or 6 having a diameter of at least 0.625 inch.

* * * * *